US006905310B2

(12) United States Patent
Kawamoto et al.

(10) Patent No.: US 6,905,310 B2
(45) Date of Patent: Jun. 14, 2005

(54) IMPELLER FOR CENTRIFUGAL COMPRESSORS

(75) Inventors: Osamu Kawamoto, Wako (JP); Mineyasu Oana, Wako (JP)

(73) Assignee: Honda Giken Kogyo Kabushiki Kaishai, Tokyo (JP)

( * ) Notice: Subject to any disclaimer, the term of this patent is extended or adjusted under 35 U.S.C. 154(b) by 47 days.

(21) Appl. No.: 10/610,885

(22) Filed: Jul. 2, 2003

(65) Prior Publication Data

US 2004/0005220 A1 Jan. 8, 2004

(30) Foreign Application Priority Data

Jul. 5, 2002 (JP) ..... 2002-197238

(51) Int. Cl.[7] ..... B64C 11/00

(52) U.S. Cl. ..... 416/175; 416/188; 416/234; 416/237

(58) Field of Search ..... 416/183, 186 R, 416/188, 223 B, 238, 235, 234, 237, 203, 175, 243

(56) References Cited

U.S. PATENT DOCUMENTS 3,133,505 A * 5/1964 Heerens et al. ..... 416/236 R
5,002,461 A * 3/1991 Young et al. ..... 416/183
5,061,154 A * 10/1991 Kington ..... 416/186 R
6,471,474 B1 * 10/2002 Mielke et al. ..... 415/199.4

FOREIGN PATENT DOCUMENTS

JP 07-91205 4/1995

* cited by examiner

*Primary Examiner*—Edward K. Look
*Assistant Examiner*—Dwayne J. White
(74) *Attorney, Agent, or Firm*—Squire, Sanders & Dempsey L.L.P.

(57) ABSTRACT

In an impeller for centrifugal compressors comprising a plurality of blades each having a base end attached to a central hub, each of the blades is given with a thickness which increases progressively toward a hub end thereof, and a suction surface side of the blade is given with a greater thickness increase rate with respect to a neutral plane than a pressure surface side of the blade. Thereby, the inter-blade channel is narrowed locally in the region near the hub end of the suction surface of each blade, and this locally reduces the aerodynamic loading on the blade. In particular, the surge property is improved, and the generation of radially outwardly directed secondary flows can be minimized. This allows the distribution of aerodynamic loading in the radial direction or from the tip end to the hub end of each blade to be controlled at will, and enables the optimum design of the impeller.

15 Claims, 11 Drawing Sheets

IMPELLER FOR CENTRIFUGAL COMPRESSORS

TECHNICAL FIELD

The present invention relates to an impeller for centrifugal compressors comprising a plurality of blades.

BACKGROUND OF THE INVENTION

Centrifugal compressors that are used in superchargers for reciprocating engines and gas turbine engines are typically provided with an impeller comprising a substantially frusto-conical hub and a plurality of blades having base ends fixedly attached to the hub and defining surfaces that are twisted relative to the central axial line. Impeller design has a strong bearing on the compression efficiency, and various proposals have been made in connection with impeller design. Such an example can be found in Japanese patent laid open publication No. 07-91205.

Each blade defines a suction surface and a pressure surface as it rotates fast with the hub. As can be readily appreciated, the mechanical stress in the blade tends to be high at the base end or hub end thereof. In particular, if the blade surfaces are tilted or leaned with respect to the normal plane as illustrated in FIG. 14, for instance, by a significant angle, the base end or hub end of the blade is subjected to a significant level of mechanical stress. Therefore, it has been customary to avoid the tilting or leaning of the blade, and design the profile of the blade so as to be substantially symmetric with respect to a central normal line (neutral plane) and to have a thickness that decreases linearly from the base end to the tip end thereof as illustrated in FIG. 15, for instance.

As higher output pressure levels (pressure ratios) are demanded from centrifugal compressors, the circumferential speed (rotational speed) and aerodynamic loading of the blades are becoming higher and higher. In particular, when the aerodynamic loading of a blade becomes excessive, particularly in the hub end of the blade, surging may occur owing to aerodynamic separation from the blade, and the efficiency of the compressor may be decreased owing to the generation of secondary flows. Also, the mechanical loading of the blade tends to be increased, and the excessive mechanical stress in the hub end of each blade reduces the durability and reliability of the compressor.

The aerodynamic loading of the hub end of each blade can be mitigated by reducing the aerodynamic loading of the tip end and/or tilting the blade with respect to the normal plane. However, increasing the tilt angle of the blade results in an increase in the mechanical stress of the hub end of the blade. In other words, there is relatively little freedom in controlling the distribution of aerodynamic loading in the radial direction or from the tip end to the hub end of each blade, and this has prevented a further improvement in the performance of compressors for a given size thereof.

In some of the existing centrifugal compressors, one or a plurality of splitter blades each having a relatively receding leading edge are provided between each pair of adjacent full blades. When there is only one splitter blade between each pair of adjacent full blades, the splitter blades are each located centrally between the opposing positive and negative surfaces of the adjoining full blades, and the blade thickness increases linearly from its leading edge in a symmetric manner with respect to the central or neutral plane thereof. Because aerodynamic separation from the leading edges of the adjacent full blades tends occur more actively from the suction surface than the pressure surface, the leading edge of the splitter blade tends to interfere with the separation flow from the suction surface of the adjacent full blade, and this has a damaging effect to the efficiency of the compressor.

BRIEF SUMMARY OF THE INVENTION

In view of such problems of the prior art, a primary object of the present invention is to provide an improved impeller for centrifugal compressors which can maximize the efficiency of the compressor by avoiding the occurrence of secondary flows.

A second object of the present invention is to provide an improved impeller for centrifugal compressors which can minimize surging without increasing the mechanical stress at the hub end of each impeller blade.

A third object of the present invention is to provide an improved impeller for centrifugal compressors comprising slitter blades which can minimize aerodynamic losses that may be otherwise produced at the leading edge of each splitter blade.

According to the present invention, at least most of these objects and other objects can be accomplished by providing an impeller for centrifugal compressors comprising a plurality of blades each having a base end attached to a central hub, characterized by that: each of the blades is given at least partly with a thickness which increases progressively toward a hub end thereof, a suction surface side of the blade having a greater thickness increase rate with respect to a neutral plane than a pressure surface side of the blade. Preferably, the thickness increase rate of the suction surface side of the blade is greater between a tip end and an intermediate point than between the intermediate point and a hub end. Typically, the neutral plane extends substantially radially from the hub.

Thereby, the inter-blade channel is narrowed locally in the region near the hub end of the suction surface of each blade, and this locally reduces the aerodynamic loading on the blade. In particular, the surge property is improved, and the generation of radially outwardly directed secondary flows can be minimized. This contributes to an improvement in the efficiency of the compressor. This, however, does not affect the aerodynamic loading on the tip end of the blade. In other words, the present invention allows the distribution of aerodynamic loading in the radial direction or from the tip end to the hub end of each blade to be controlled at will, and this enables the optimum design of the impeller. Furthermore, this creates a thickened portion in the hub end of the blade on the suction surface side of the blade, and this relatively reinforces the blade against bending stress.

To achieve a same goal, a hub surface between opposing surfaces of each adjacent pair of blades may be tilted or leaned with respect to a circumferential plane in such a manner that the hub surface adjacent to the suction surface is further away from a rotational center line of the hub than the hub surface adjacent to the pressure surface.

According to a preferred embodiment of the present invention, the blades include full blades and at least one splitter blade between each pair of adjacent full blades, a leading edge of each of the splitter blades being tilted toward the opposing suction surface of the adjacent full blade. This conforms the leading edge of the splitter blade to the oncoming flow which may contain a certain amount of separation flow created by the suction surface of the adjacent full blade so that the interference of the leading edge of the splitter blade with such a separation flow can be minimized.

In such a case, the splitter blade is preferably provided with a blade thickness which rapidly increases from a leading edge thereof as compared with a leading edge of the full blades. This prevents a creation of a sudden local increase in the inter-blade channel area or width, and generation of separation flow from the splitter blade can be minimized. According to a preferred embodiment of the present invention, the blade thickness of each splitter blade is asymmetric with respect to a neutral plane of the splitter blade. For instance, the splitter blade may include a section having a relatively constant thickness or a locally reduced thickness in a part somewhat downstream of the leading edge, preferably on the suction surface side of the splitter blade so that the angular change rate of the suction surface side of the splitter blade and hence the generation of separation flow therefrom may be minimized.

To the end of preventing secondary flows from the leading edge of each splitter blade, the leading edge of each of the splitter blade adjacent to the hub surface may be provided with a scallop portion.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
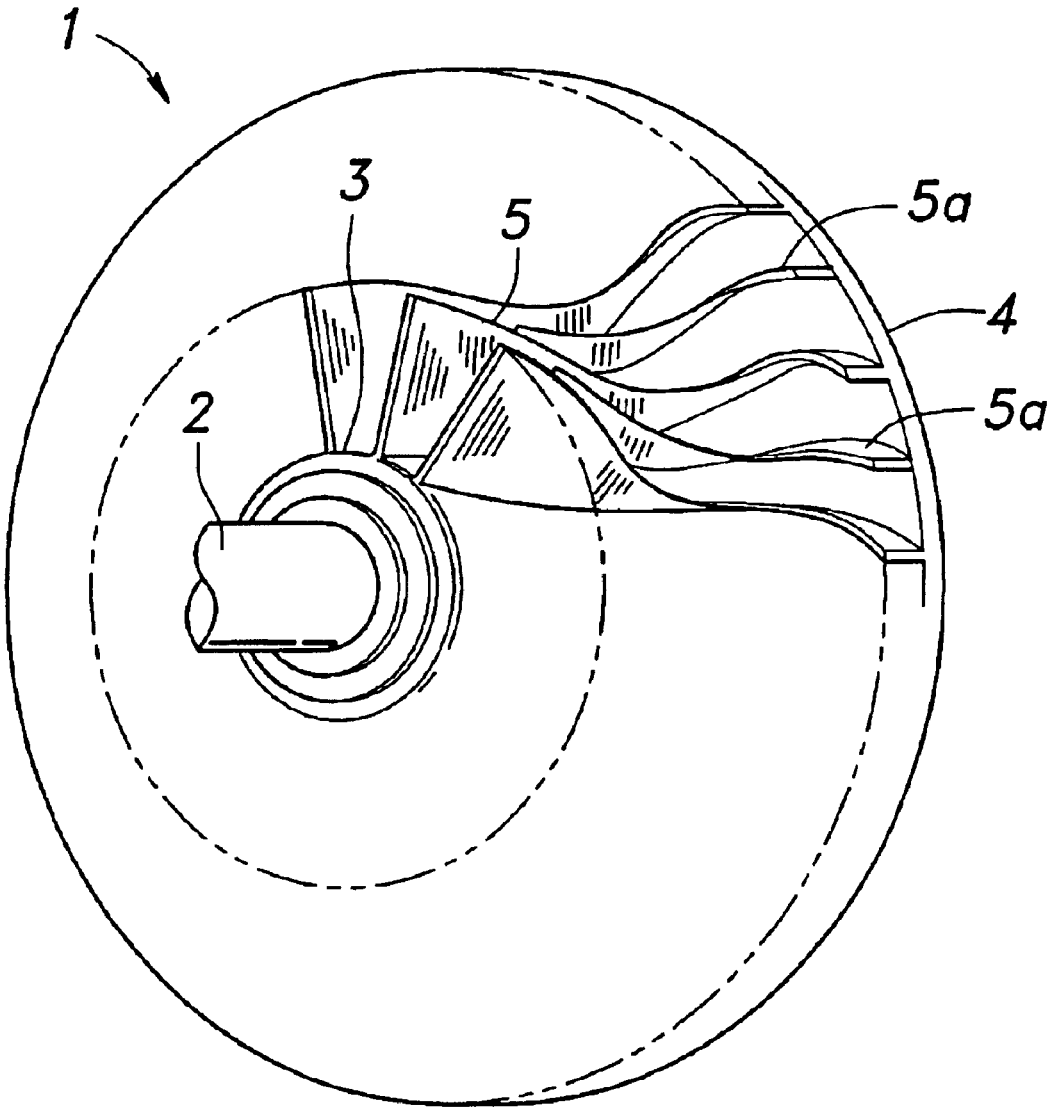
FIG. 1 is a fragmentary perspective view of an impeller for centrifugal compressors embodying the present invention.

FIG. 1 is a fragmentary perspective view of an impeller of a centrifugal compressor embodying the present invention. The impeller 1 comprises a substantially frusto-conical hub 3 fixedly fitted on a rotor shaft 2, a disk 4 integrally and coaxially formed at the broader axial end of the hub 3 and a plurality of blades 5 and 5*a* projecting from a surface defined by the hub 3 and disk 4. The blades include full blades 5 and splitter blades Sa that are arranged in an alternating fashion along the circumference of the hub 3. Preferably, the hub 3, disk 4 and blades 5 and 5*a* are formed by machining a one-piece blank member made of titanium alloy or stainless steel. FIG. 1 shows only a part of the blades that are arranged over the entire circumference of the hub 3 at an equal interval.

Figure 2:
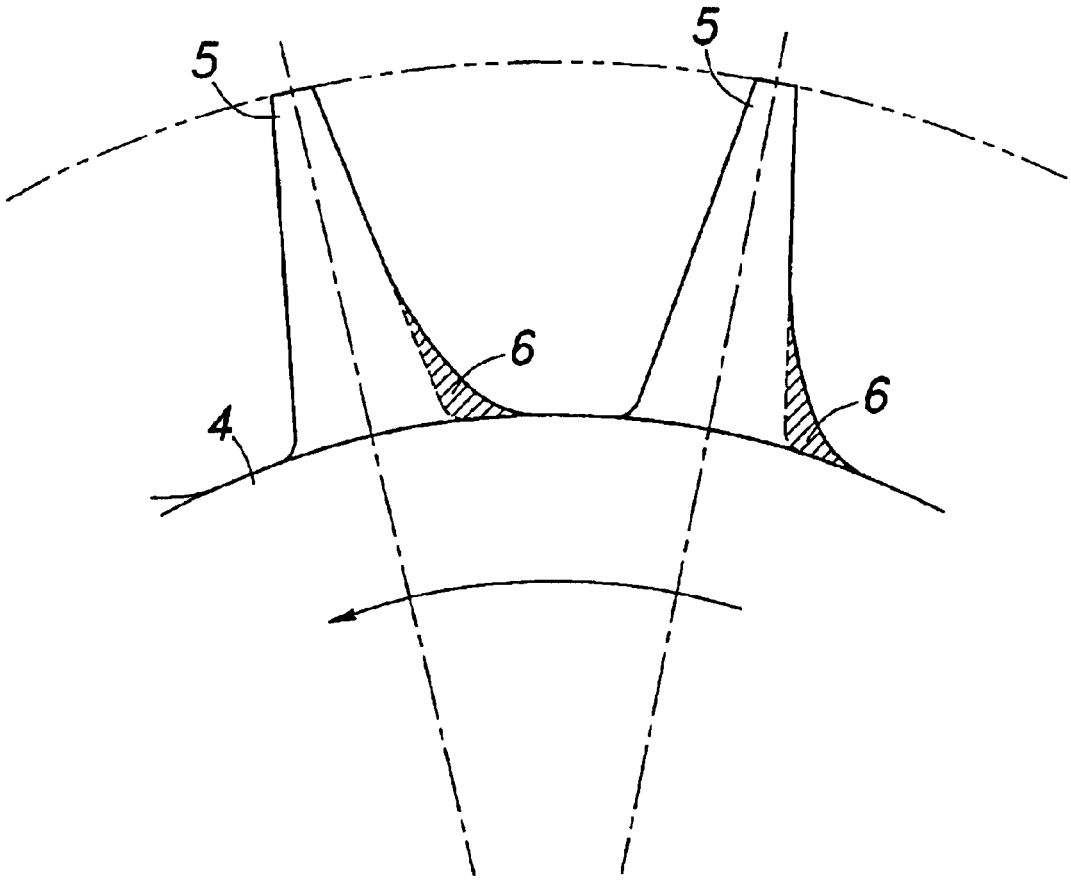
FIG. 2 is a fragmentary end view of blades as seen from the inlet end in a somewhat exaggerated manner.

As shown in a somewhat exaggerated manner in FIG. 2, each blade has a substantially linearly increasing thickness from the tip end to the hub end, and is provided with a greater thickness on the side of the negative surface pressure as indicated by numeral 6. In other words, the cross section of each blade is somewhat asymmetric with respect to the central normal line, the suction surface being further away from the normal plane than the pressure surface. In other words, the suction surface side of the blade is given with a greater thickness increase rate with respect to a neutral plane than the pressure surface side of the blade. The increase rate in thickness from the tip end to the hub end may be either substantially constant or may be greater between the intermediate point and hub end than between the tip end and intermediate point.

Figure 3:
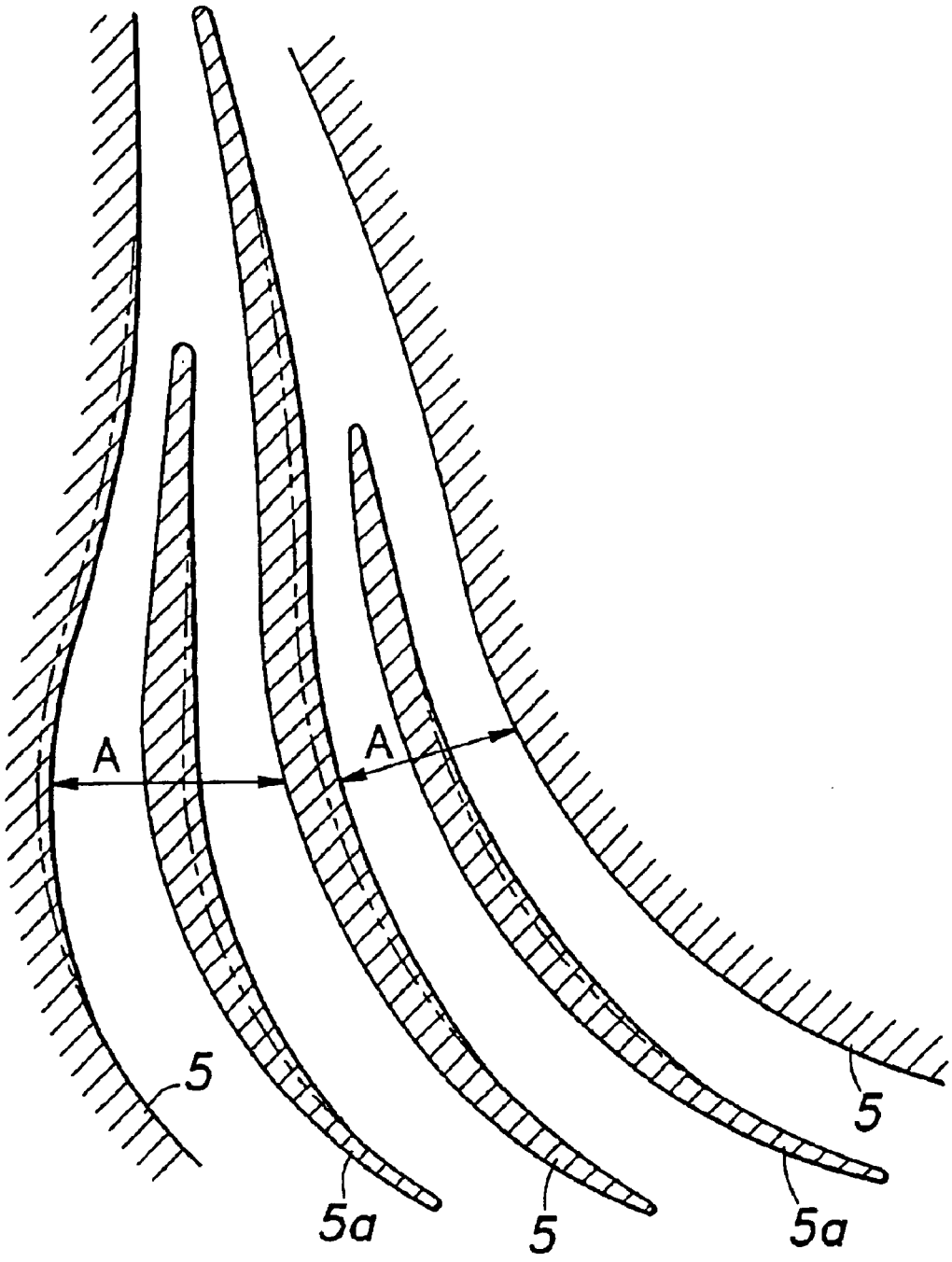
FIG. 3 is a sectional view taken along a plane parallel to the hub surface.

By thus defining the cross sectional profile of each blade in this fashion or so as to be thicker on the side of the suction surface than on the side of the pressure surface with respect to the central normal plane, the blade spacing A on the hub surface can be reduced locally as compared with that of a conventional arrangement (indicated by the imaginary lines) as illustrated in FIG. 3 so that the aerodynamic loading on the hub end of the blade can be reduced without unduly increasing the mechanical stress at the hub end of the blade. Also, because the curvature of the suction surface of the blade which is prone to aerodynamic separation is reduced, surge property can be improved and generation of secondary flows near the hub end of the blade can be minimized. A splitter blade 5*a* is provided between each pair of adjacent full blades 5 for flow straightening in the illustrated embodiment, but the present invention is applicable to those having no splitter blades as well.

Figure 4:
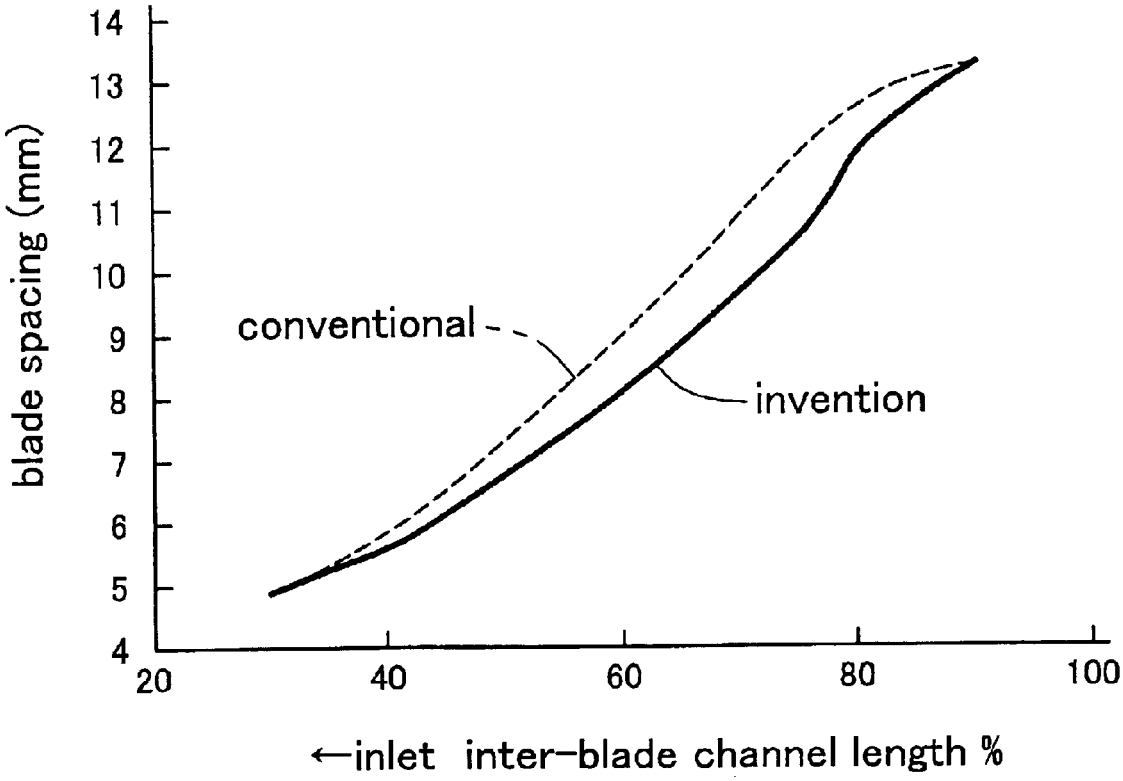
FIG. 4 is a graph showing the inter-blade spacing in relation with the position along the length of the inter-blade channel.
Figure 5A:
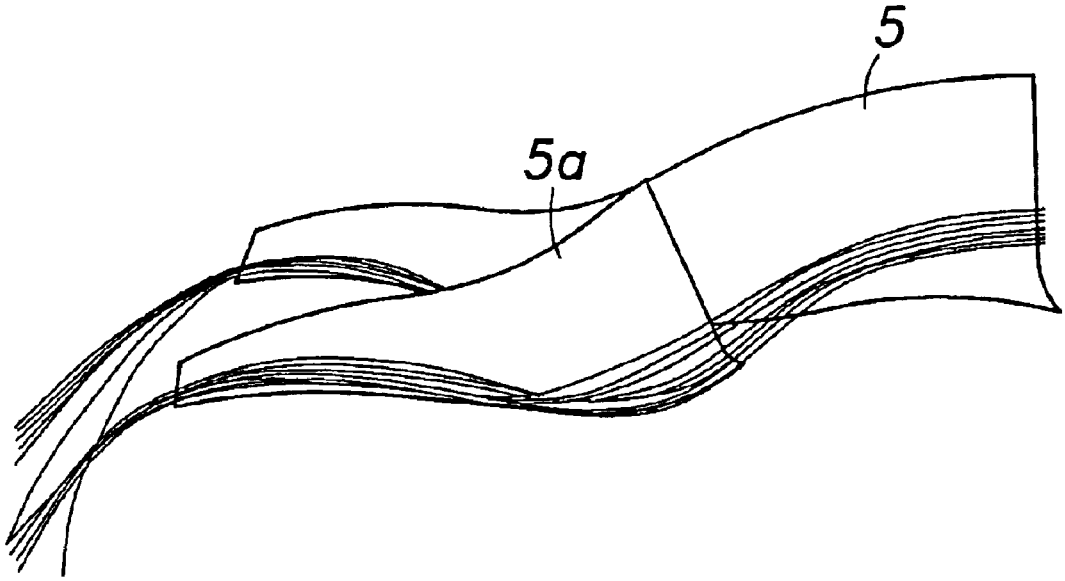
FIG. 5*a* is a fragmentary schematic perspective view showing secondary flows around the blades each having a thickened portion shown in FIG. 2.
Figure 5B:
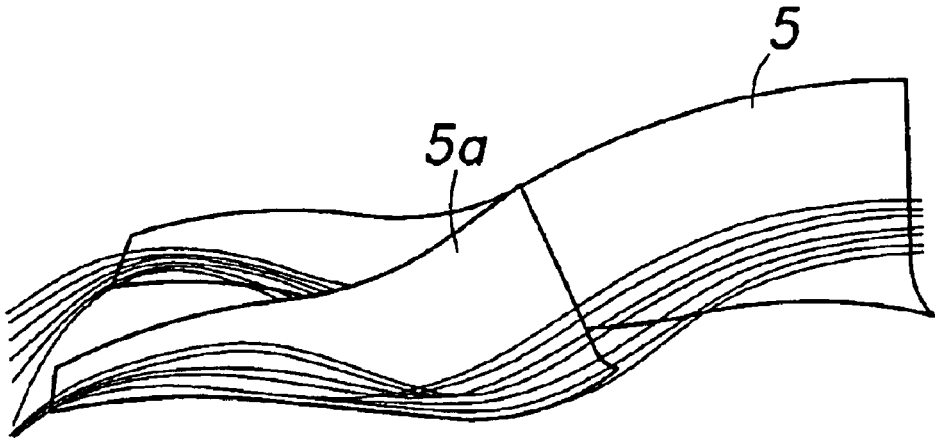
FIG. 5*b* is a view similar to FIG. 5*a* when the blades have no thickened portion.

The improvement that is achieved by providing a thickened portion 6 in the part of each blade which is subjected to a relatively high aerodynamic load (in the area which is between 40% to 80% of the entire length of the inter-blade channel as measured from the inlet end) was evaluated. FIG. 4 shows the blade spacing A on the hub surface in relation to the position along the length of the inter-blade channel with and without the thickened portion 6. The present invention (with the thickened portion 6) resulted in a substantial reduction in secondary flows near the hub end of each blade (be it a full blade 5 or a splitter blade 5*a*) as indicated by the narrowing of the flow and absence of radially outward flow (FIG. 5*a*) as compared with the conventional arrangement (FIG. 5*b*).

Figure 6:
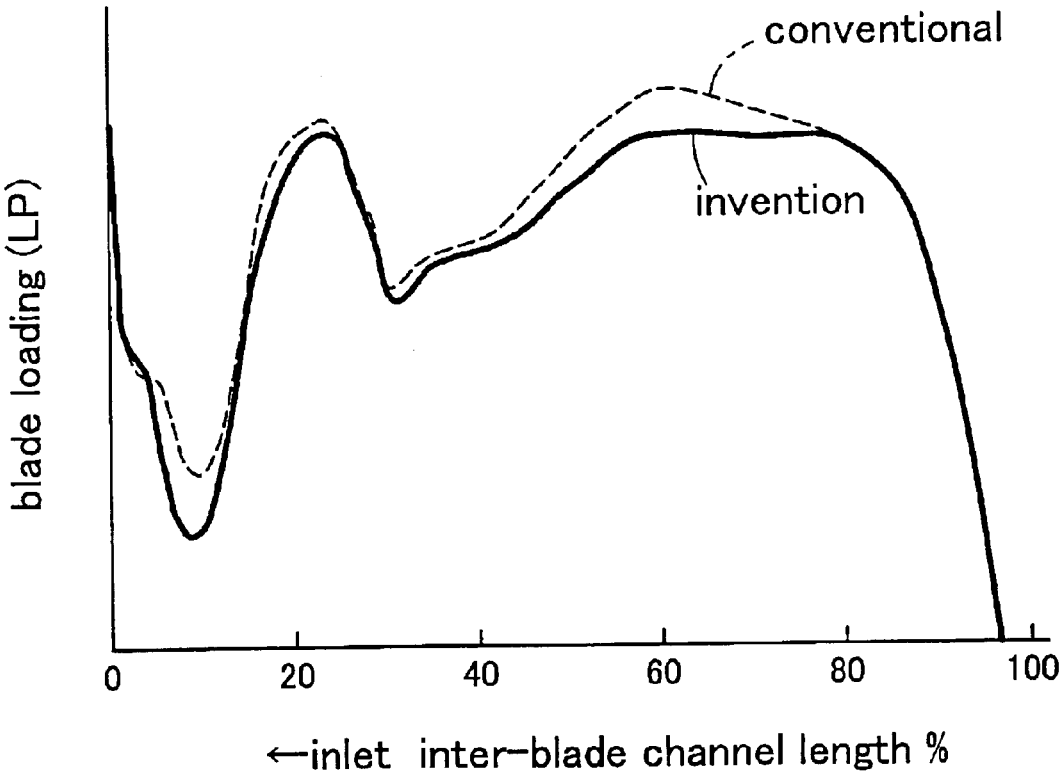
FIG. 6 is a graph showing the relationship between the aerodynamic blade loading and the position along the length of the inter-blade channel.

This is also corroborated by the graph of FIG. 6 showing the aerodynamic load (LD: loading parameter) which is given by $LD=(W_{suction}-W_{pressure})/W_{average}$ where $W_{negative}$ is the load on the suction surface, $W_{pressure}$ is the load on the pressure surface and $W_{average}$ is the average load on the two surfaces. It can be seen that the reduction in the aerodynamic blade loading is most significant in the region of 40 to 80% in terms of the distance into the inter-blade channel as measured from the inlet end as shown in the graph of FIG. 6.

The secondary flow in the boundary layer is directed to the leading edge of each blade at a higher incident angle as compared with the main flow. Therefore, by extending a hub end portion of the leading edge of the blade in the upstream direction, generation of the secondary flows can be minimized because the boundary layer flow produces vortices as it goes over the extended portion (scallop portion) and re-attach to the blade once again. Preferably, this extension consists of a scallop portion or an extension which defines a concave curve directed to the upstream end as illustrated in FIG. 7*a*.

Figure 7A:
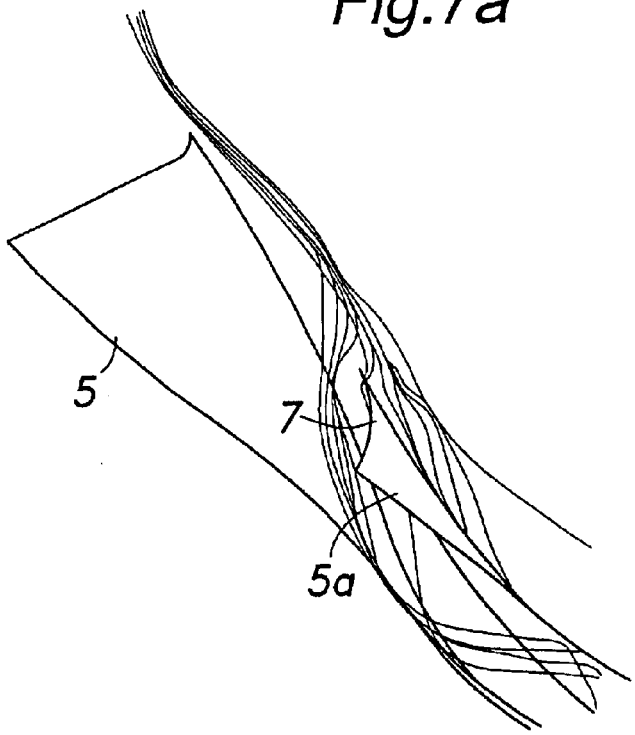
FIG. 7*a* is a fragmentary schematic perspective view showing secondary flows around the blades each having a scallop portion.
Figure 7B:
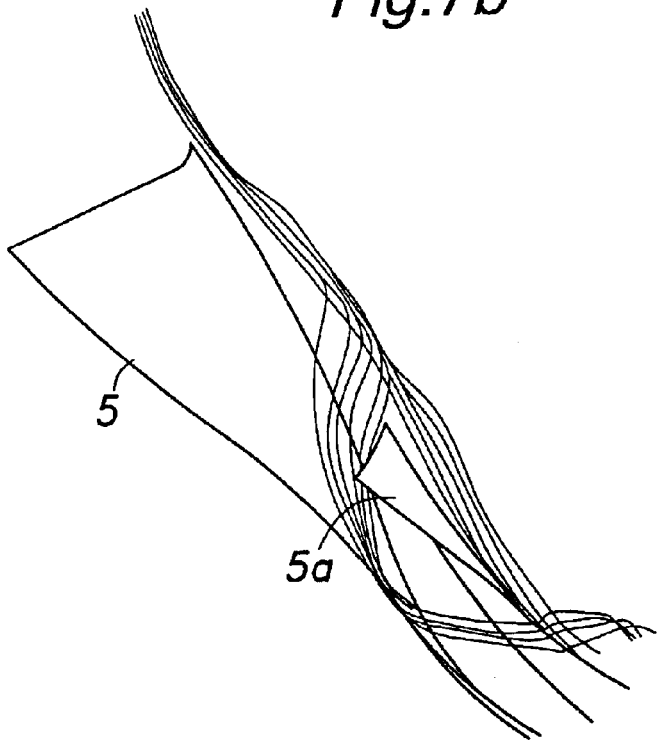
FIG. 7*b* is a view similar to FIG. 7*a* when the blades have no scallop portion.

FIG. 7*a* shows a splitter blade provided with such an extended portion (scallop portion) 7, and it can be seen that the secondary flow that has gone over the extended portion attaches to the blade, and the secondary flow is more favorably controlled as compared with the one having no such extended portion which is shown in FIG. 7*b*. As can be readily appreciated, similar advantage as mentioned earlier can be gained when such an extended portion is provided in a full blade.

Figure 8:
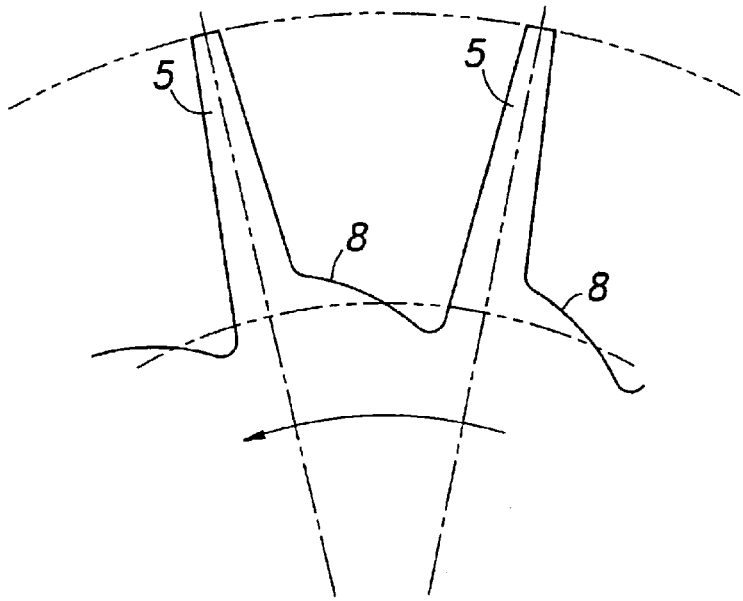
FIG. 8 is a view similar to FIG. 2 showing a second embodiment of the present invention.

FIG. 8 shows a second embodiment of the present invention in which the channel surface 8 defined on the outer circumferential surface of the hub 3 between each adjacent pair of blades 6 is contoured in such a manner that it is raised adjacent to the suction surface and recessed adjacent to the pressure surface. In other words, as seen in the cross section, the channel surface 8 extends progressively further away from the center of the rotor shaft 2 from the side adjacent to the pressure surface to the side adjacent to the suction surface. This provides advantages similar to those achieved by the provision of the thickened portions 6 illustrated in FIG. 2.

Figure 9:
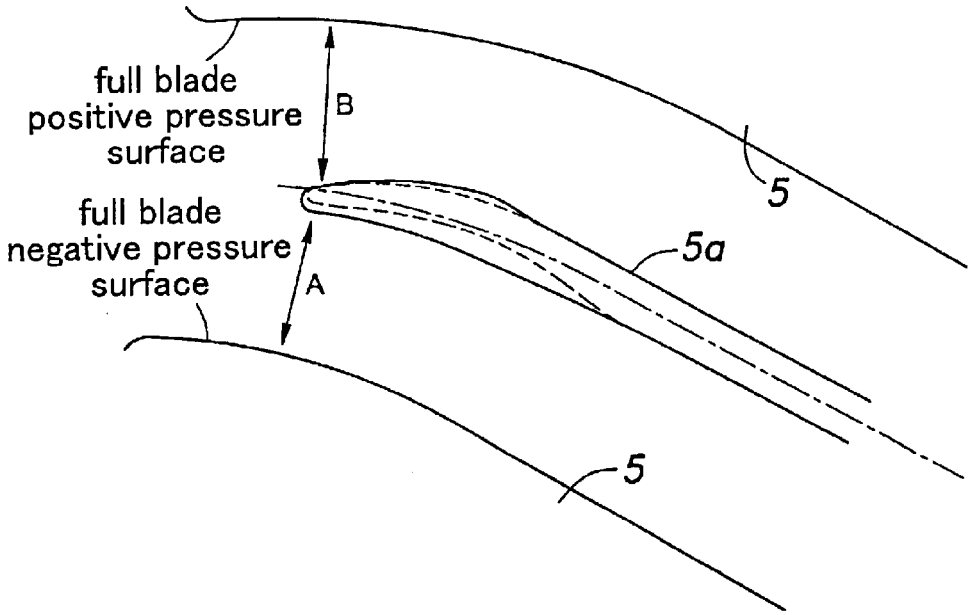
FIG. 9 is a fragmentary developed view of inter-blade channels showing the relationship between the splitter blades and full blades.

Referring to FIG. 9, when a splitter blade Sa extending from a somewhat receding point from the inlet point between each adjacent pair of full blades, the leading edge of each splitter blade 5*a* may interfere with the separation flow from the suction surface of the corresponding full blade 5, and this could reduces the efficiency of the compressor. To eliminate this problem, it is conceivable to bend the leading edge of the splitter blade so as to conform to the actual flow in this area as indicated by the broken lines in FIG. 9.

Figure 10:
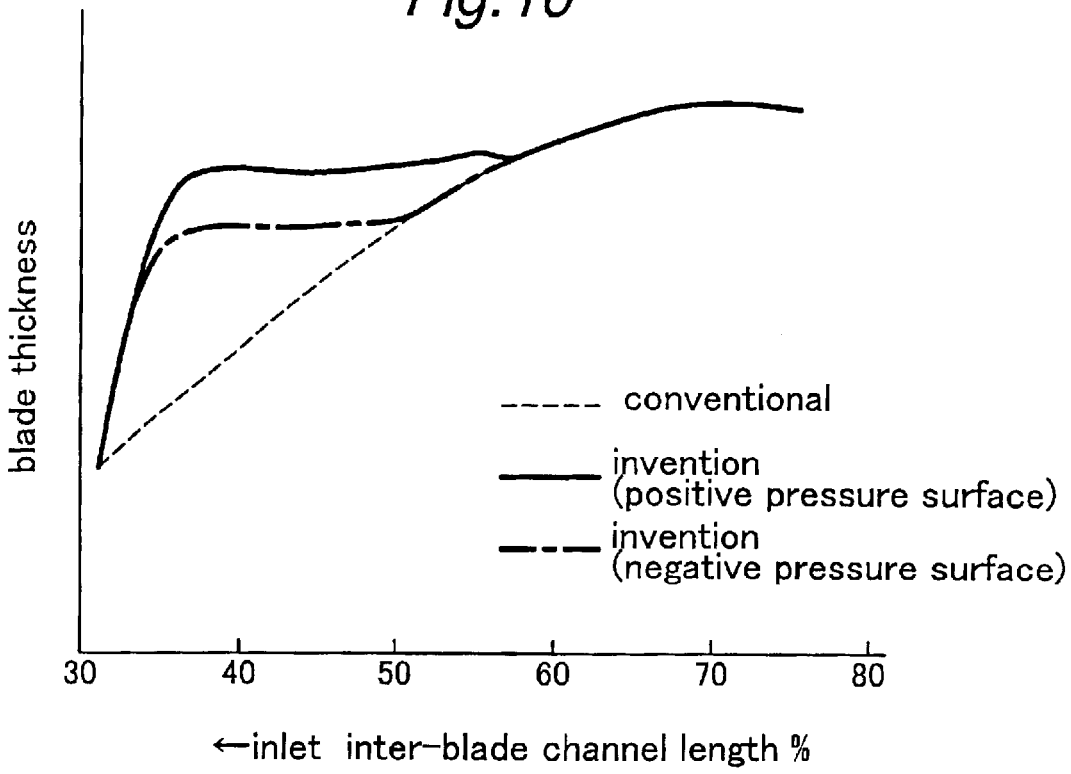
FIG. 10 is a graph showing the relationship between the blade thickness and the position along the length of the inter-blade channel according to a preferred embodiment of the present invention.
Figure 11:
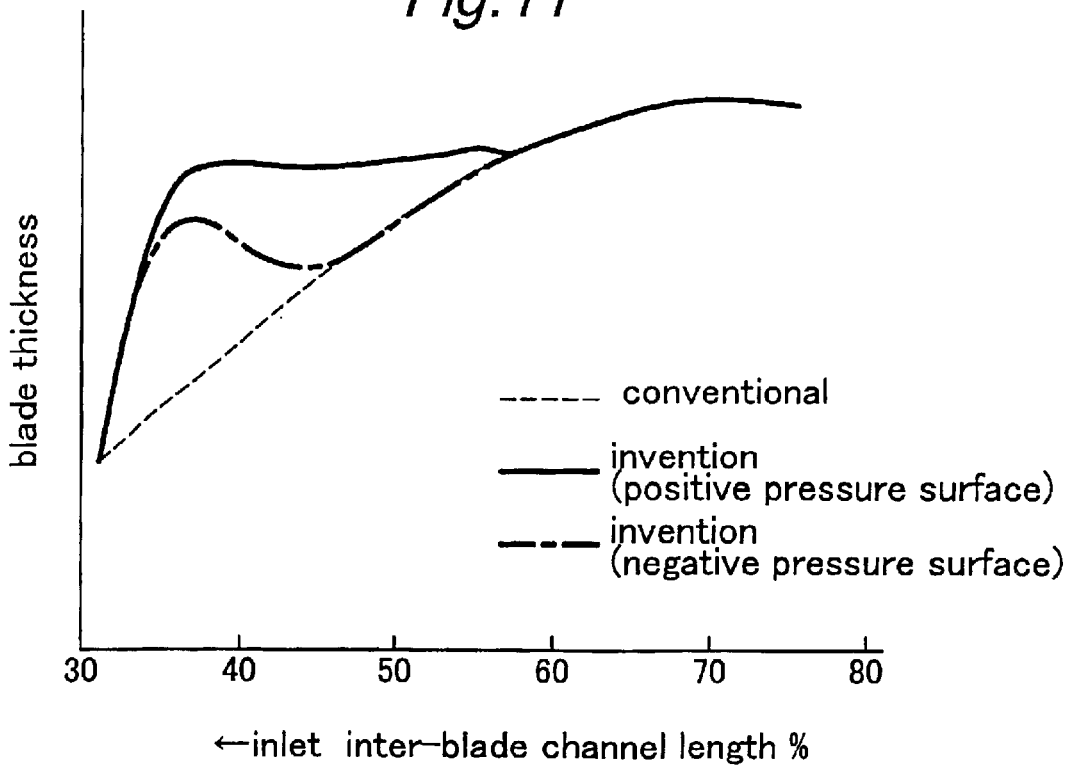
FIG. 11 is a view similar to FIG. 10 according to another preferred embodiment of the present invention.
Figure 12:
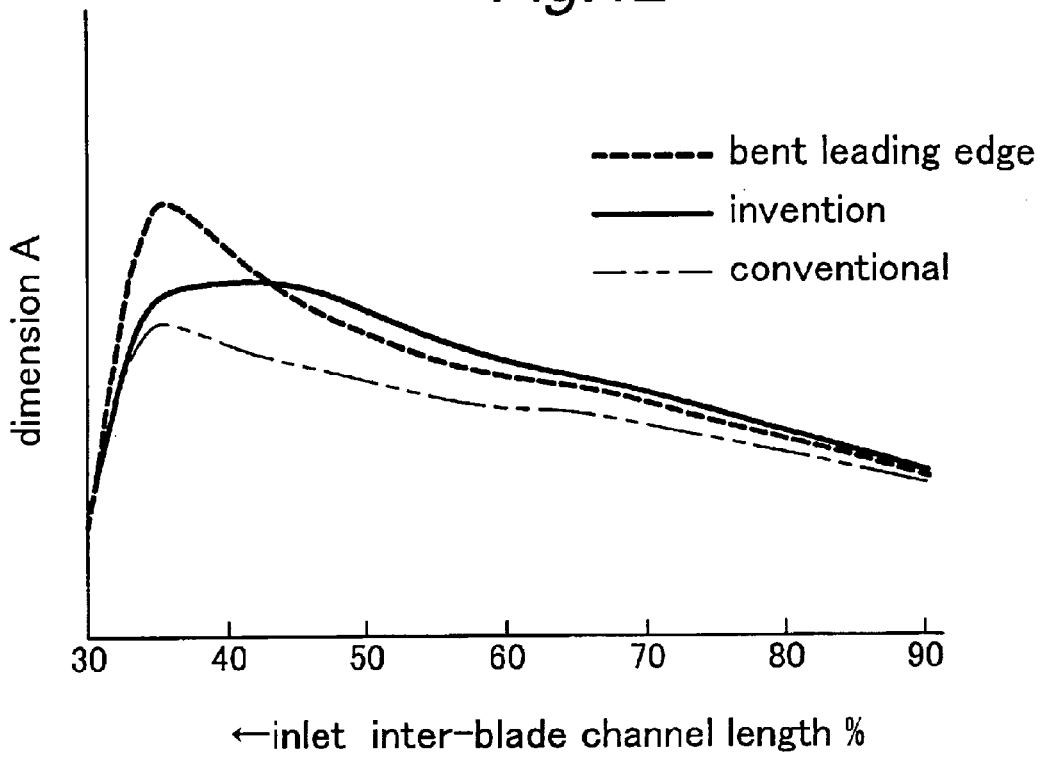
FIG. 12 is a graph showing the change in the inter-blade channel width A in relation with the position along the length of the inter-blade channel.
Figure 13:
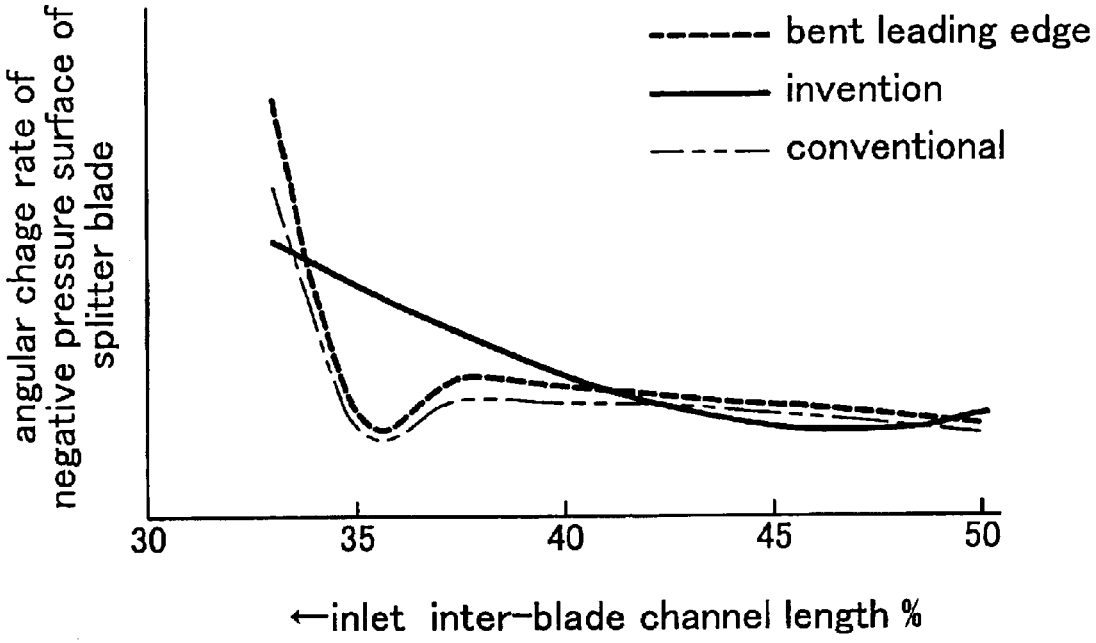
FIG. 13 is a graph showing the angular change rate of the suction surface of a splitter blade.
Figure 14:
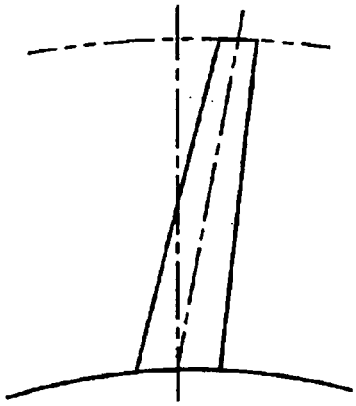
PRIOR ART Fig. 14
FIG. 14 is a sectional view of a blade which would give rise to a high mechanical stress.
Figure 15:
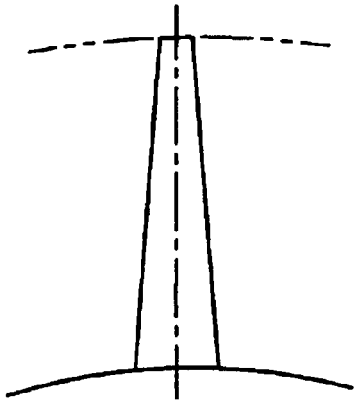
PRIOR ART Fig. 15
FIG. 15 is a sectional view of a typical conventional blade.

In the embodiment illustrated in FIG. 9, each splitter blade 5*a* is bent at the leading edge of thereof with respect to the corresponding part of the full blades 5 by one to seven degrees to conform it to the actual flow and, at the same time, is given with a blade thickness which increases sharply from the leading edge as shown by the solid lines. The thickness of the splitter blade is kept substantially at a same level from an intermediate point thereof for the remaining length thereof as shown in FIG. 10. Optionally, the splitter blade may be optionally provided with an intermediate section which includes a slightly decrease in thickness which is followed by an increase as shown in FIG. 11. More specifically, as shown in the graphs of FIGS. 10 and 11, the blade thickness sharply increases from the leading edge in an asymmetric manner with respect to the positive and negative pressures surfaces while being kept substantially constant over the remaining part of the blade, optionally with a section involving a slight dip in a somewhat downstream part of the splitter blade. This prevents a sudden increase in the inter-blade channel area as indicated by the solid line in FIG. 12, and at the same time prevents a sudden change in the angular change rate of the suction surface of the splitter blade as indicated by the solid line in FIG. 13. The broken lines in FIGS. 12 and 13 indicate the results when only the leading edge is only bent without modifying the blade thickness.

The deviation of the angle of the leading edge of each splitter blade 5*a* with respect to the corresponding part of the full blades is preferably in the range of three to four degrees, and more preferably in the range of one to seven degrees. It was experimentally demonstrated that if this angular deviation exceeds seven degrees the splitter blade itself tends to promote the generation of a separation flow.

Although the present invention has been described in terms of preferred embodiments thereof, it is obvious to a person skilled in the art that various alterations and modifications are possible without departing from the scope of the present invention which is set forth in the appended claims.

What is claimed is:

1. An impeller for centrifugal compressors comprising a plurality of blades each having a base end attached to a frusto-conical central hub and a disk integrally and coaxially formed at a broader axial end of the hub, and a leading edge located at a narrower axial end of the hub, characterized by that: each of said blades is given at least partly with a thickness which increases progressively toward a hub end thereof, a suction surface side of said blade having a greater thickness increase rate with respect to a neutral plane than the thickness increase rate of pressure surface side of said blade.

2. An impeller for centrifugal compressors according to claim 1, wherein said neutral plane extends substantially radially from said hub.

3. An impeller for centrifugal compressors according to claim 1, wherein said thickness increase rate of said suction surface side of said blade is greater between a tip end and an intermediate point than between the intermediate point and a hub end.

4. An impeller for centrifugal compressors according to claim 1, wherein a hub surface between opposing surfaces of each adjacent pair of blades is tilted with respect to a circumferential plane in such a manner that the hub surface adjacent to the suction surface is further away from a rotational center line of said hub than the hub surface adjacent to the pressure surface.

5. An impeller for centrifugal compressors according to claim 1, wherein said blades include full blades and at least one splitter blade between each pair of adjacent full blades, a leading edge of each of said splitter blades being bent toward the opposing suction surface of the adjacent full blade.

6. An impeller for centrifugal compressors according to claim 5, wherein said splitter blade is provided with a blade thickness which rapidly increases from a leading edge thereof as compared with a leading edge of the full blades.

7. An impeller for centrifugal compressors according to claim 6, wherein said blade thickness of each splitter blade is asymmetric with respect to a neutral plane of the splitter blade.

8. An impeller for centrifugal compressors according to claim 7, wherein said splitter blade includes a section having a relatively constant thickness or a locally reduced thickness in a part somewhat downstream of said leading edge.

9. An impeller for centrifugal compressors according to claim 5, wherein the leading edge of each of said splitter blade adjacent to said hub surface is provided with a scallop portion.

10. An impeller for centrifugal compressors comprising a plurality of blades each having a base end attached to a central hub, characterized by that: a hub surface between opposing surfaces of each adjacent pair of blades is tilted with respect to a circumferential plane in such a manner that the hub surface adjacent to the suction surface is further away from a rotational center line of said hub than the hub surface adjacent to the pressure surface.

11. An impeller for centrifugal compressors according to claim 10, wherein said blades include full blades and at least one splitter blade between each pair of adjacent full blades, a leading edge of each of said splitter blades being bent toward the opposing suction surface of the adjacent full blade.

12. An impeller for centrifugal compressors according to claim 11, wherein said splitter blade is provided with a blade thickness which rapidly increases from a leading edge thereof as compared with a leading edge of the full blades.

13. An impeller for centrifugal compressors according to claim 12, wherein said blade thickness of each splitter blade is asymmetric with respect to a neutral plane of the splitter blade.

14. An impeller for centrifugal compressors according to claim 13, wherein said splitter blade includes a section having a relatively constant thickness or a locally reduced thickness in a part somewhat downstream of said leading edge.

15. An impeller for centrifugal compressors according to claim 11, wherein the leading edge of each of said splitter blade adjacent to said hub surface is provided with a scallop portion.

* * * * *